US007104106B1

(12) United States Patent
Loignon

(10) Patent No.: US 7,104,106 B1
(45) Date of Patent: Sep. 12, 2006

(54) METHOD AND APPARATUS FOR FORMING RADIUS BENDS IN METAL FRAMES

(76) Inventor: Francois Loignon, 3380 A Chelsea Park La., Norcross, GA (US) 30092

( * ) Notice: Subject to any disclaimer, the term of this patent is extended or adjusted under 35 U.S.C. 154(b) by 0 days.

(21) Appl. No.: 10/699,993

(22) Filed: Nov. 3, 2003

(51) Int. Cl.
*B21D 5/16* (2006.01)
*B21D 17/02* (2006.01)
*B21J 13/08* (2006.01)

(52) U.S. Cl. ..... 72/387; 72/388; 72/459; 72/479

(58) Field of Classification Search ..... 72/381, 72/387, 388, 479, 459
See application file for complete search history.

(56) References Cited

U.S. PATENT DOCUMENTS

| | | | | |
|---|---|---|---|---|
| 1,356,567 | A | | 10/1920 | Smith |
| 2,638,958 | A | | 5/1953 | Norquist |
| 2,729,265 | A | | 1/1956 | Jones |
| 3,156,034 | A | | 11/1964 | Gruetjen |
| 3,583,199 | A | | 6/1971 | Speiser |
| 3,636,690 | A | | 1/1972 | White |
| 3,732,721 | A | * | 5/1973 | Cusimano ..... 72/388 |
| 3,753,366 | A | | 8/1973 | White |
| 4,048,837 | A | * | 9/1977 | Spencer et al. ..... 72/387 |
| 4,559,805 | A | * | 12/1985 | McClure ..... 72/479 |
| 5,426,967 | A | | 6/1995 | Sparlin |
| 6,138,359 | A | | 10/2000 | Mears |
| 6,418,773 | B1 | | 7/2002 | Tolman |

* cited by examiner

*Primary Examiner*—David Jones
(74) *Attorney, Agent, or Firm*—Patent Focus, Inc.; Richard C. McComas

(57) ABSTRACT

An apparatus to form bends in a substantially rectangular metal frame. The substantially rectangular metal frame is selectively positioned in an elongated radius bend jig. The elongated radius bend jig has a pivotally connected mandrel that has an inverted J-shaped die formed at one end. The mandrel is actuated and the inverted J-shaped die engages the substantially rectangular metal frame causing an indentation in the substantially rectangular metal frame. The process of die stamping the substantially rectangular metal frame is continued until a selected radius is formed in the frame.

8 Claims, 7 Drawing Sheets

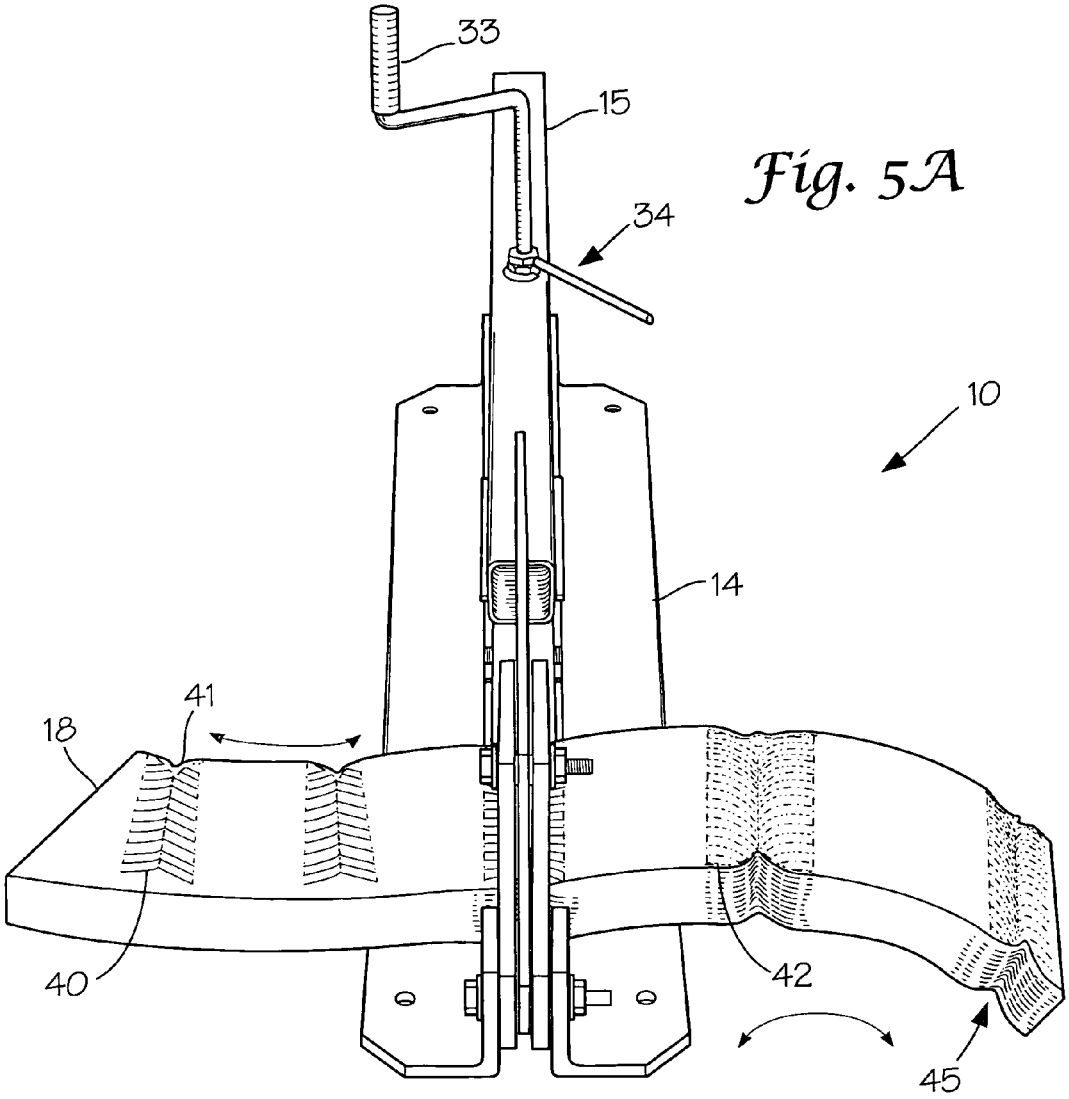
Fig. 5A
Fig. 5B
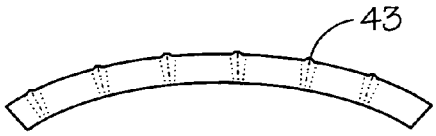
Fig. 5C
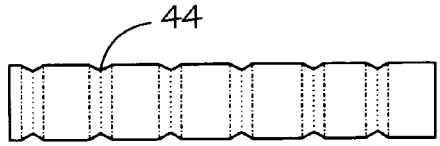

METHOD AND APPARATUS FOR FORMING RADIUS BENDS IN METAL FRAMES

FIELD OF THE INVENTION

The invention relates, in general, to an apparatus for forming geometric shapes from rectangular metal frames. In particular, the invention relates to an apparatus to form radius bends into rectangular metal frames producing geometric shapes. More particularly, the invention relates to a method and apparatus for forming single and double radius bends into rectangular metal frames to produce selected geometric shapes.

BACKGROUND OF THE INVENTION

Historically, curved frames structures used to support walls and ceilings have difficult and time-consuming construction problems. The typically, solution to this problem is to cut short segments of sheet metal frame members and attach them to a plywood base panel at the top and bottom of a wall or at the ends of a ceiling section to define the desired curved configuration. Suitably spaced studs are fixed at their ends to the segments to define the prescribed curvature of the wall or ceiling construction.

Another attempt to solve the above discussed problem is to have a multi-step crimping machine that crimps elongated rectangular metal frames. The multi-step crimping action produces an arcuate metal frame that may be used for mounting drywall or other material to form a curved wall. The multi-step crimping machine requires two or more steps to crimp the elongated rectangular metal frames. Multi-step crimping machines are mechanically complex and the process of performing more than one crimping step is time consuming.

It would be desirable to have a single step metal crimping machine that is mechanically simple and that one person can operate. The single step metal machine would not only produce arcuate bends to elongated rectangular metal frames and it would produce a plurality of geometric shapes from the elongated rectangular metal frames.

SUMMARY

The present invention is an apparatus to form bends in a substantially rectangular metal frame. The substantially rectangular metal frame is selectively positioned in an elongated radius bend jig. The elongated radius bend jig has pivotally connected thereto a mandrel that has an inverted J-shaped die formed at one end. The mandrel is actuated and the inverted J-shaped die engages the substantially rectangular metal frame causing an indentation therein. The process of die stamping the substantially rectangular metal frame is continued until a selected radius is formed in the frame. The newly formed radius bent metal frame may, if desired, be removed from the elongated radius bend jig and the metal frame rotated end to end. The radius bent metal frame is re-inserted into the elongated radius bend jig and the above discussed radius bending process is repeated. The double radius bent metal frame is removed from the elongated radius bend jig and formed into a selected geometric shape.

When taken in conjunction with the accompanying drawings and the appended claims, features and advantages of the present invention become apparent upon reading the following detailed description of the embodiments of the invention.

BRIEF DESCRIPTION OF THE DRAWINGS

The invention is illustrated in the drawings in which like reference characters designate the same or similar parts throughout the figures of which:

FIG. 5*a* illustrates a top-level schematic view diagram of a combination bending process of a rectangular metal frame, FIG. 5*b* illustrates a top-level schematic view diagram of a radius bend in the rectangular metal frame of FIG. 5*a*, FIG. 5*c* illustrates a top-level schematic view diagram of an arcuate bend in the rectangular metal frame of FIG. 5*b*.

DETAILED DESCRIPTION

Figure 1:
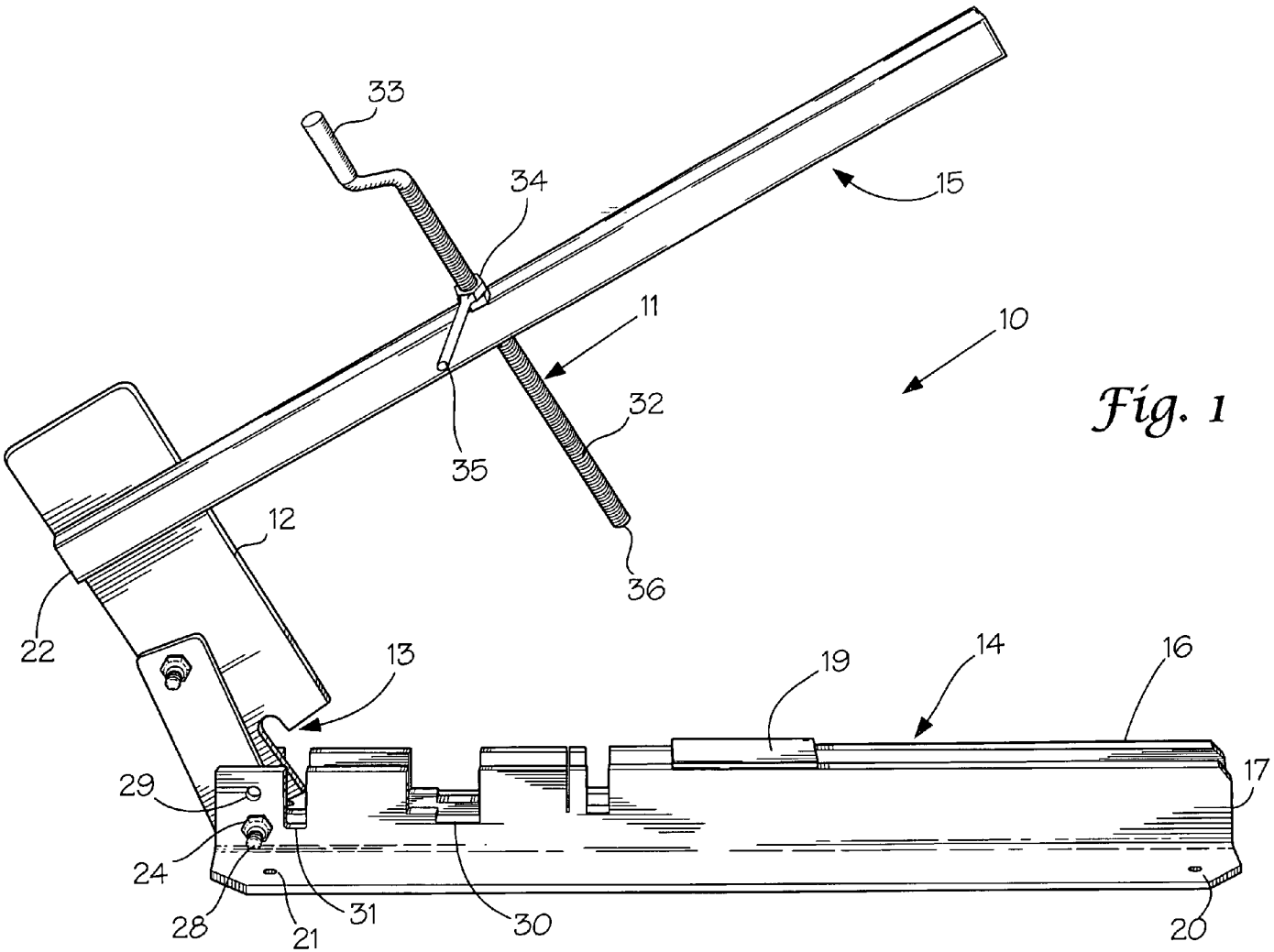
FIG. 1 illustrates a top-level schematic view diagram of a mandrel pivotally connected to a radius bend jig.

Before describing in detail the particular improved apparatus for forming a radius bends in substantially rectangular metal frames in accordance with the present invention, it should be observed that the invention resides primarily in a novel structural combination of conventional components, prefabricated components or machined manufactured structures and the operating process thereof and not in the particular detailed configuration thereof. Accordingly, the structure and arrangement of these conventional components have, for the most part, been illustrated in the drawings by readily understandable diagrams. The drawings show only those specific details that are pertinent to the present invention in order not to obscure the disclosure with structural details which will be readily apparent to those skilled in the art having the benefit of the description herein. For example, an elongated radius bend stop mechanism 11, FIG. 1 has an elongated threaded rod 32 with an L-shaped crank 33 mountably disposed at one end. The elongated threaded rod 32 is illustrated as having threads extending substantially the length. Various portions forming the elongated threaded rod 32 have been simplified in order to emphasize those portions that are most pertinent to the invention. Thus, the diagram illustrations of the Figures do not necessarily represent the mechanical structural arrangement of the exemplary system, but are primarily intended to illustrate major hardware structural components of the system in a convenient functional grouping whereby the embodiment of the present invention may be more readily understood.

An overview of the present invention: The present invention 10, FIG. 1 is an apparatus to form bends in a substantially rectangular metal frame 18, FIG. 3*a*. The substantially rectangular metal frame is selectively positioned in an elongated radius bend jig 14. The elongated radius bend jig 14 has pivotally connected thereto a mandrel 12 that has an inverted J-shaped die 13 formed at one end. The mandrel 12 is actuated and the inverted J-shaped die 13 engages the substantially rectangular metal frame 18 causing an indentation therein. The process of die stamping the substantially rectangular metal frame 18 is continued until a selected radius is formed in the frame. The newly formed radius bent metal frame may, if desired, be removed from the elongated radius bend jig 14 and the metal frame rotated end to end. The radius bent metal frame 18 is reinserted into the elongated radius bend jig 14 and the above discussed radius bending process is repeated. The double radius bent metal frame is removed from the elongated radius bend jig 14, manipulated or formed into a selected geometric shape.

A more detailed discussion of the present invention: The present invention 10, FIG. 1 is an apparatus for forming at least one radius bend into a substantially rectangular metal frame 18, FIG. 3*a*. The apparatus has a mandrel 12 with an inverted J-shaped die 13 formed at one end 23. The mandrel 12 may, if desired, be substantially rectangular with two long sides adjoined to two short sides. One short side of the substantially rectangular mandrel 12 has a portion thereof formed into an inverted J-shaped die 13. The inverted J-shaped die 13 is medially positioned along the short side.

An elongated handle 15, FIG. 1 is adjacently spaced from the substantially rectangular mandrel's 12 other end oppositely spaced from the inverted J-shaped die 13. The elongated handle 15 may, if desired, be perpendicularly connected 22 to the substantially rectangular mandrel 12 by any convenient means. Examples of convenient means are welding, nut and bolt and casting.

Figure 2:
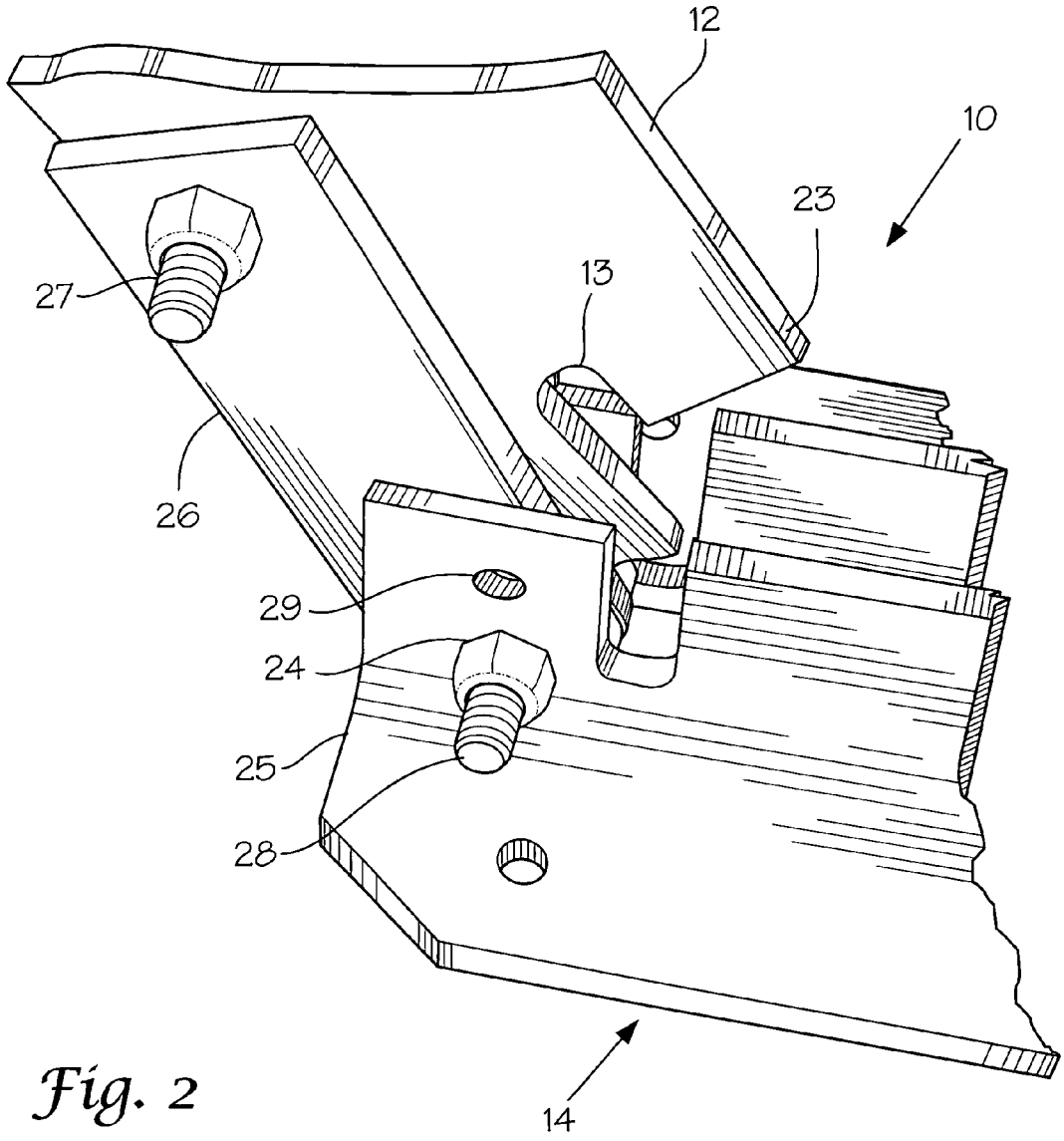
FIG. 2 illustrates a top-level schematic view diagram of the pivotal connection of FIG. 1.

An elongated radius bend jig 14, FIG. 1 is adjacently spaced from the substantially rectangular mandrel 12 and is pivotally connected thereto. The elongated radius bend jig 14 is formed from a pair of spaced apart elongated L-shaped members 16 and 17. The spaced apart L-shaped members 16 and 17 are mounted back-to-back forming a base to receive the substantially rectangular metal frame 18 via a plurality of slots 30 and 31. The spaced apart L-shaped members 16 and 17 are secured in-place by a connecting bracket 19. The connection of the bracket 19 to the L-shaped members 16 and 17 is by any convenient means. Examples of convenient means are welding, nut and bolt and casting. The elongated radius bend jig 14 may, if desired, be secured to a stand or other structure via connection holes 20 and 21. Other securing connection holes may, if desired, be formed in the elongated radius bend jig 14. One end 25, FIG. 2 of the elongated radius bend jig 14 is pivotally connected to the substantially rectangular mandrel 12 by a pair of substantially rectangular pivot arms 26. The pair of substantially rectangular pivot arms 26 pivotally secures the substantially rectangular mandrel 12 to the elongated radius bend jig 14 via a pair of nuts and bolts 27 and 28. The depth at which the pair of substantially rectangular pivot arms 26 extend into the space between the L-shaped members 16 and 17 is adjustable via adjusting holes 24 or 29.

The elongated radius bend stop mechanism 11, FIG. 1 is an elongated threaded rod 32 which extends through the elongated handle 15 via a mating threaded structure embedded in the elongated handle 15. A locking mechanism 34 is annularly disposed about the elongated threaded rod 32. The locking mechanism 34 has an adjusting handle 35 to secure the elongated radius bend stop mechanism 11 to the elongated handle 15. One end 36 of the elongated threaded rod 32 engages the connecting bracket 19 of the elongated radius bend jig 14 when the elongated handle 15 is actuated. The elongated threaded rod 32 engaging the connecting bracket 19 and adjustably controls the depth upon which the inverted J-shaped die 13 extends into the substantially rectangular metal frame 18.

Figure 3A:
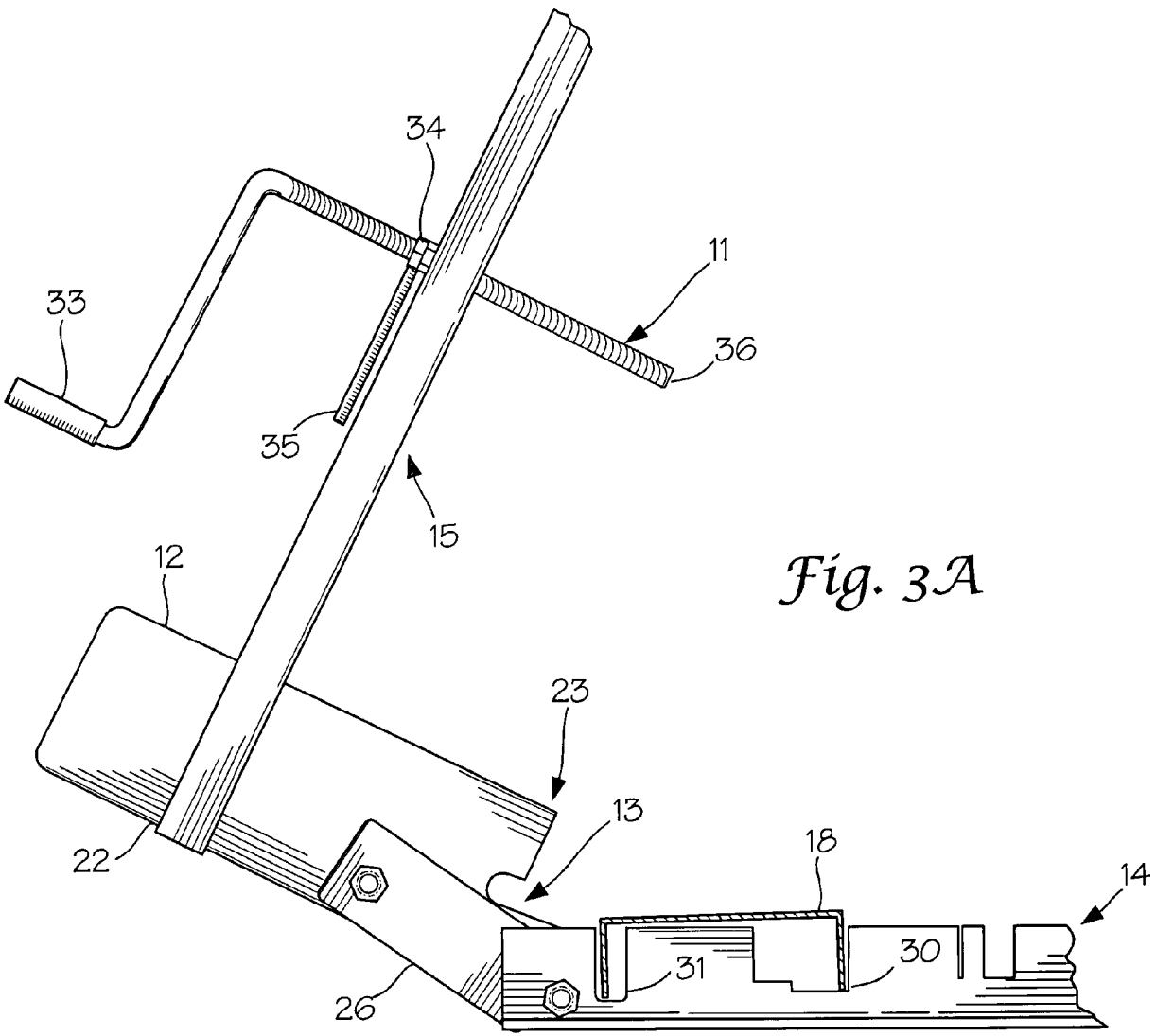
FIG. 3*a* illustrates a top-level schematic view diagram of a first position of the radius bend process of FIG. 1.
Figure 3B:
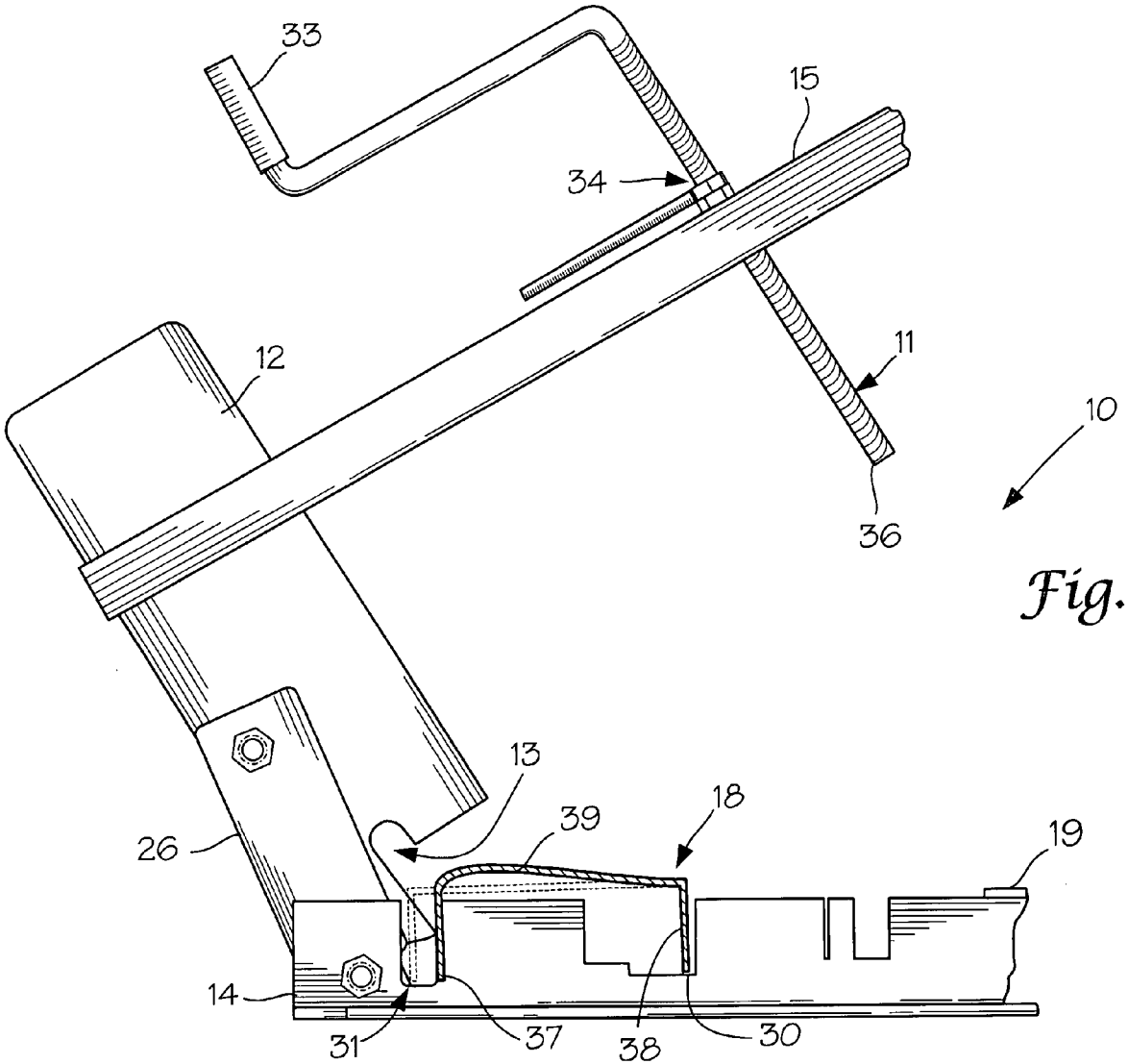
FIG. 3*b* illustrates a top-level schematic view diagram of a second position of the radius bend process of FIG. 1.
Figure 3C:
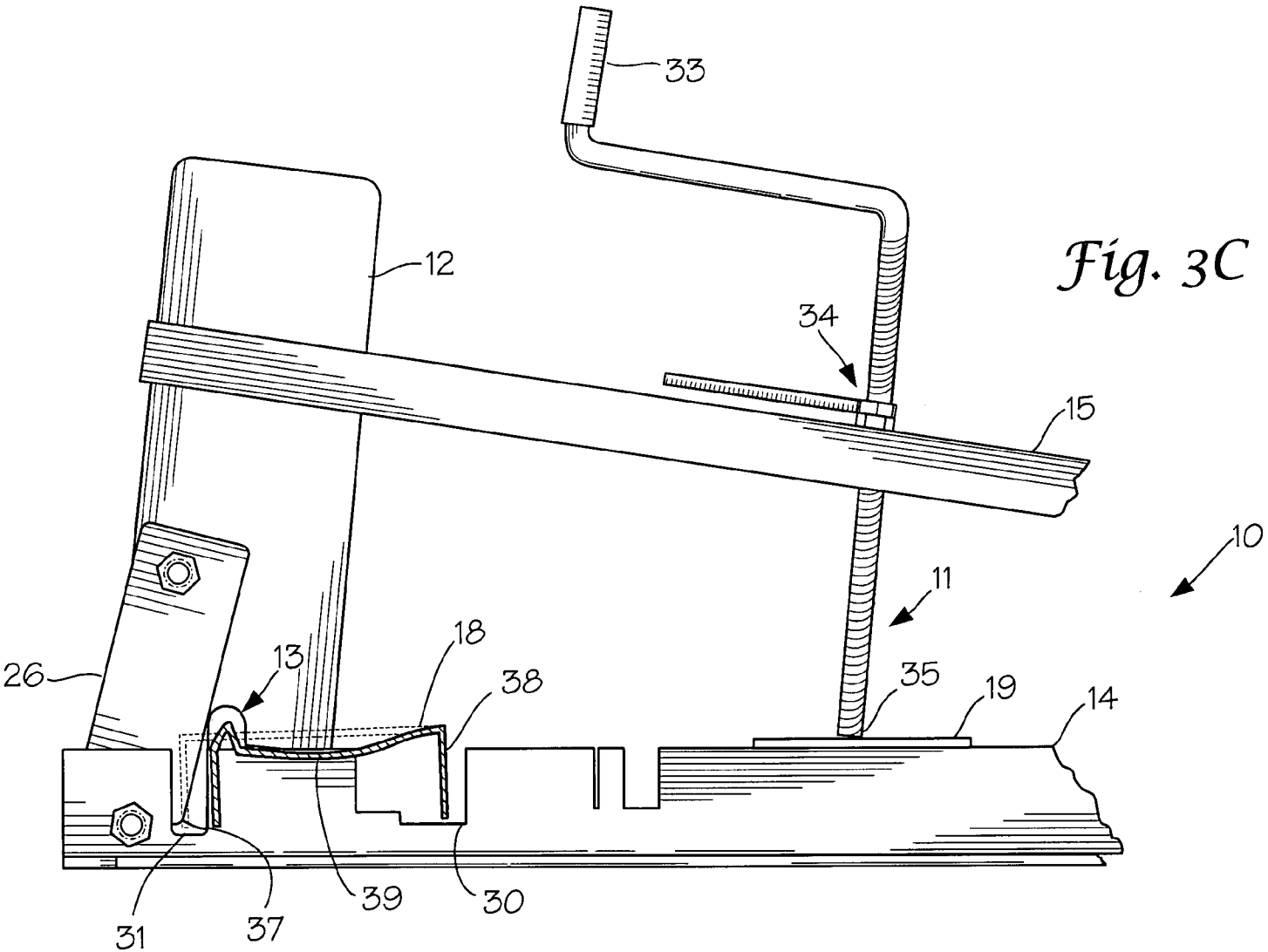
FIG. 3*c* illustrates a top-level schematic view diagram of a third position of the radius bend process of FIG. 1.
Figure 4A:
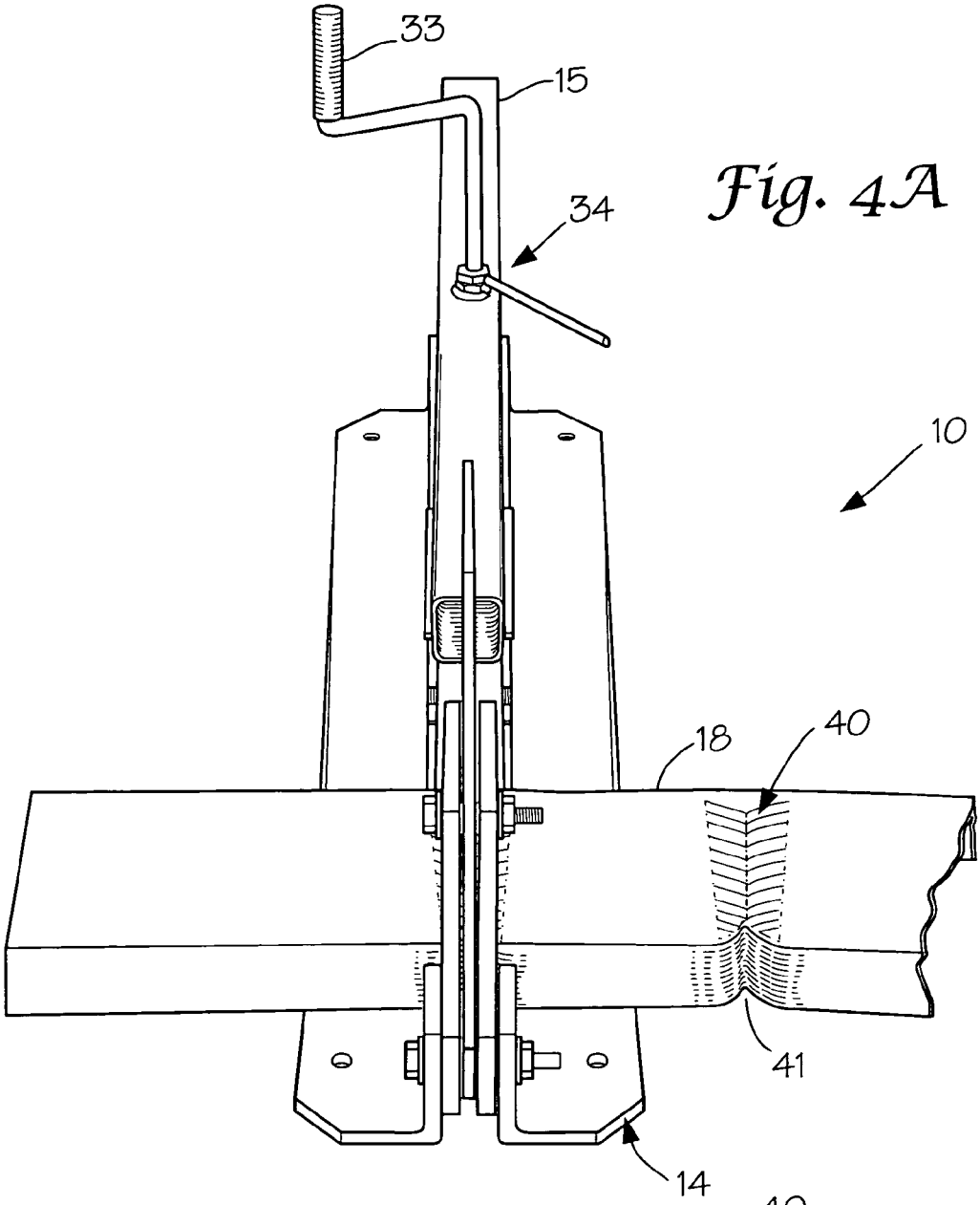
FIG. 4*a* illustrates a top-level schematic view diagram of the radius bend process in a rectangular metal frame.
Figure 4B:
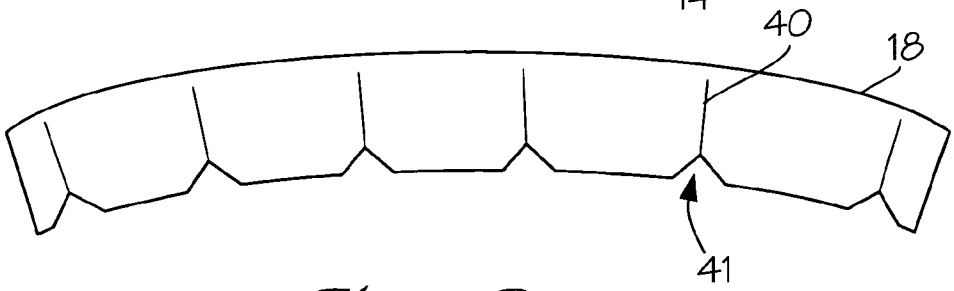
FIG. 4*b* illustrates a top-level schematic view diagram of an arcuate bend in the rectangular metal frame of FIG. 4*a*.

In operation the substantially rectangular mandrel's 12, FIG. 3*a* elongated handle 15 is sufficiently raised to allow the selective insertion of the substantially rectangular metal frame 18 into elongated radius bend jig 14. The elongated handle 15, FIG. 3*b* is actuated by pressing downward on the elongated handle 15. This action pivotally rotates the substantially rectangular mandrel's 12 FIG. 3*b* inverted J-shaped die 13 engaging the substantially rectangular metal frame 18 causing the inverted J-shaped die 13 to inscribe an indentation 41, FIG. 4*a* in the substantially rectangular metal frame's 18 leading edge 37. The substantially rectangular metal frame's 18, FIG. 3*c* leading edge 37 is urged towards the trailing edge 38 causing a protuberance 39, FIG. 3*b* to arise from the substantially rectangular metal frame 18. The inverted J-shaped die 13 engages the metal protuberance 39 causing a V-shaped indentation 40, FIG. 4*a* on the top surface of the substantially rectangular metal frame 18. The above discussed process is selectively continued until the desired radius is formed in the substantially rectangular metal frame 18. An example of a substantially rectangular metal frame 18, FIG. 4*b* that has the above discussed process implemented thereon is illustrated in FIG. 4*b*.

A plurality of geometric shapes may, if desired, be formed using the present invention 10, FIG. 5*a*. The formed radius bent metal frame 18 may, if desired, be removed from the elongated radius bend jig 14 and the metal frame rotated end to end. The radius bent metal frame 18 is reinserted into the elongated radius bend jig 14 and the above discussed radius bending process is repeated resulting in a double radius bend 42. The double radius bend 42 is removed from the elongated radius bend jig and manipulated or formed into a selected geometric shape. Exemplary geometric shapes are the arcuate metal frame 43, FIG. 5*b*, the S-curved metal frame 45, FIG. 5*a* and the universal geometric metal frame 44, FIG. 5*c*.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claim, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An apparatus for forming radius bends into a substantially rectangular metal frame comprising:

a) an elongated mandrel having an inverted J-shaped die formed at one end;

b) an elongated handle having one end perpendicularly connected to one end oppositely spaced from said inverted J-shaped die of said mandrel;

c) an elongated radius bend jig adjacently spaced from said elongated mandrel's inverted J-shaped die end, said elongated radius bend jig having one end pivotally connected to said elongated mandrel;

d) said elongated radius bend jig having operationally disposed therein the substantially rectangular metal frame; and e) said inverted J-shaped die mounted mandrel being selectively actuated via said elongated handle urging said inverted J-shaped die into the elongated radius bend jig forming the radius bend into the metal frame.

2. An apparatus for forming radius bends as recited in claim 1 further comprising:

f) an elongated radius bend stop mechanism mountably disposed to said elongated handle;

g) said elongated radius bend stop mechanism having one end engaging said elongated radius bend jig;

h) said elongated radius bend stop mechanism's other end forming a crank to set the depth of said inverted J-shaped die forming the radius bend into the metal frame; and i) a locking mechanism disposed about said elongated radius bend stop mechanism, said locking mechanism engaging said elongated handle thereby locking said locking mechanism to said elongated handle.

3. An apparatus for forming radius bends as recited in claim 2 wherein said radius bend stop mechanism comprises:

a) an elongated threaded rod having one end inserted through a mating threaded portion of said elongated handle;

b) said elongated threaded rod's other end formed into an L-shaped crank;

c) a threaded locking nut with an outwardly extending arm connected thereto, said threaded locking nut mating to the threads of said elongated threaded rod;

d) said threaded locking nut engaging said elongated handle locking said threaded locking nut in-place.

4. An apparatus for forming radius bends as recited in claim 1 wherein said elongated mandrel comprises:

a) a substantially rectangular member having two short sides and two long sides;

b) said substantially rectangular member having said inverted J-shaped die formed along one short side; and c) said substantially rectangular member's other short side having said elongated handle adjacently spaced and connectively disposed thereto.

5. An apparatus for forming radius bends as recited in claim 1 wherein said elongated radius bend jig comprises:

a) a pair of back to back mounted substantially rectangular L-shaped members, said L-shaped members having a top portion;

b) said L-shaped members having disposed therebetween said elongated mandrel's inverted J-shaped die end;

c) said L-shaped members being pivotally connected to said elongated mandrel; and d) a plurality of slots disposed along said L-shaped member's top portion, said plurality of slots being aligned with and spaced from said elongated mandrel.

6. A method of forming radius bends into a substantially rectangular metal frame comprising the steps of:

a) providing an elongated mandrel having an inverted J-shaped die formed at one end; said elongated mandrel pivotally mounted to an elongated radius bend jig, said elongated radius bend jig having a plurality of slots disposed therein;

b) inserting the rectangular metal frame in said slots;

c) actuating said elongated mandrel; and d) forming the radius bend in the rectangular metal frame via said actuated elongated mandrel.

7. A method of forming radius bends as recited in claim 6 further comprising the steps of:

e) removing said radius bent metal frame from said elongated radius bend jig;

f) rotating said radius bent metal frame end to end;

g) inserting said rotated radius bent metal frame in said slots;

h) actuating said elongated mandrel; and i) forming a selected bend in said rotated radius bent metal frame via said actuated elongated mandrel.

8. A method of forming radius bends as recited in claim 7 wherein said step of forming a selected bend comprises the step of selecting a bend from a group of geometric shapes consisting of an S-shape, circular shape, arcuate shape, oval shape and rectangular shape.

* * * * *